US009022793B2

(12) United States Patent
Kobayashi et al.

(10) Patent No.: US 9,022,793 B2
(45) Date of Patent: May 5, 2015

(54) LEVER TYPE CONNECTOR

(75) Inventors: Tohru Kobayashi, Makinohara (JP); Shoji Yamamoto, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/808,140

(22) PCT Filed: Jul. 19, 2011

(86) PCT No.: PCT/JP2011/066788

§ 371 (c)(1),
(2), (4) Date: Jan. 3, 2013

(87) PCT Pub. No.: WO2012/011597

PCT Pub. Date: Jan. 26, 2012

(65) Prior Publication Data

US 2013/0102168 A1 Apr. 25, 2013

(30) Foreign Application Priority Data

Jul. 20, 2010 (JP) ..... 2010-163083

(51) Int. Cl.

| | |
|---|---|
| ***H01R 13/62*** | (2006.01) |
| ***H01R 13/629*** | (2006.01) |
| ***H01R 13/52*** | (2006.01) |
| *H01R 13/64* | (2006.01) |

(52) U.S. Cl.

CPC ..... *H01R 13/6295* (2013.01); *H01R 13/5213* (2013.01); *H01R 13/62938* (2013.01); *H01R 13/62955* (2013.01); *H01R 13/64* (2013.01)

(58) Field of Classification Search

CPC ..... H01R 13/62938

USPC ..... 439/157

See application file for complete search history.

(56) References Cited

U.S. PATENT DOCUMENTS

| | | | |
|---|---|---|---|
| 5,709,560 | A | 1/1998 | Hio |
| 5,735,702 | A | 4/1998 | Hio |
| 7,267,564 | B2 | 9/2007 | Bauman et al. |

(Continued)

FOREIGN PATENT DOCUMENTS

| | | | |
|---|---|---|---|
| CN | 1131346 | A | 9/1996 |
| DE | 10 2004 013 476 | A1 | 11/2004 |

(Continued)

OTHER PUBLICATIONS

International Search Report (PCT/ISA/210) dated Sep. 30, 2011, issued by the International Searching Authority in International Application No. PCT/JP2011/066788.

(Continued)

*Primary Examiner* — Phuong Dinh
(74) *Attorney, Agent, or Firm* — Sughrue Mion, PLLC

(57) ABSTRACT

There is provided a lever type connector. In the lever type connector in which an electric wire cover is attached to a connector housing to which a lever is already fitted, a false fitting preventing projection that protrudes from the electric wire cover and prevents the false fitting of the electric wire cover when this projection comes into contact with the lever is provided, and the false fitting preventing projection protrudes outward rather than the connector housing and an outer surface of the lever. The false fitting preventing projection absorbs an impact applied from the outside, and serves as a cushioning member against at least the connector housing.

1 Claim, 5 Drawing Sheets

(56) References Cited

U.S. PATENT DOCUMENTS

| | | | | |
|---|---|---|---|---|
| 7,563,114 | B2 | 7/2009 | Patterson | |
| 2003/0181083 | A1 | 9/2003 | Kozono et al. | |
| 2005/0026484 | A1 | 2/2005 | Demuth | |
| 2006/0154505 | A1 | 7/2006 | Nishide | |
| 2007/0087599 | A1 | 4/2007 | Sasaki et al. | |
| 2008/0102668 | A1 * | 5/2008 | Ikeya et al. | 439/157 |
| 2011/0230071 | A1 | 9/2011 | Shamoto et al. | |
| 2012/0208383 | A1 | 8/2012 | Kobayashi et al. | |

FOREIGN PATENT DOCUMENTS

| | | | |
|---|---|---|---|
| DE | 10 2011 012 065 | A1 | 12/2011 |
| DE | 11 2011 100 247 | T5 | 11/2012 |
| EP | 0 975 065 | A3 | 1/2000 |
| JP | 6-36242 | U | 5/1994 |
| JP | 8-288009 | A | 11/1996 |
| JP | 2003-272755 | A | 9/2003 |
| JP | 2006-196225 | A | 7/2006 |
| JP | 2007-115443 | A | 5/2007 |
| JP | 2008-97990 | A | 4/2008 |

OTHER PUBLICATIONS

Written Opinion (PCT/ISA/237) dated Sep. 30, 2011, issued by the International Searching Authority, in International Application No. PCT/JP2011/066788.

Notification of Reasons for Refusal, dated Jul. 1, 2014, issued by the Japanese Patent Office in counterpart Japanese Application No. 2010-163083.

Office Action dated Sep. 3, 2014 issued by the State Intellectual Property Office of P.R. China in corresponding Application No. 201180035758.3.

Communication dated Nov. 27, 2014 issued by the German Patent and Trademark Office in counterpart German Patent Application No. 11 2011 102 426.6.

* cited by examiner

LEVER TYPE CONNECTOR

TECHNICAL FIELD

The present invention relates to a lever type connector.

BACKGROUND ART

The lever type connector capable of reducing fitting force between the mutual connectors has been known (see JP-A-2008-97990, JP-A-2003-272755, JP-UN-A-6-36242, for example). The connector of this type possesses such an advantage that even the multi-terminal connector can be coupled with a small fitting force because this connector utilizes a "lever action" of the lever. As the common structure, this lever type connector is equipped with the connector housing, the lever, and the electric wire cover. When the opposite connector is placed to face the lever side connector in a state that the lever is set in its initial position and then the lever is turned to its final position, the engaging pins provided to the opposite connector are pulled in the fitting direction along cam grooves that are formed in the lever. In this way, the fitting operation between the opposite connector and the lever side connector is completed. In such lever type connector, the electric wire cover can be fitted to the connector housing in both the non-reverse direction and the reverse direction as the opposite direction to the non-reverse direction. As a result, the electric wires can be pulled out from either of the right and left sides in response to the fitting direction of the electric wire cover, a margin of laving of the electric wire can be increased, and the electric wire laying operation can be executed effective JP-A-2008-57990, JP-A-2003-272755 and JP-UM-A-6-36242 are considered as conventional art of the invention.

SUMMARY OF THE INVENTION

Technical Problem

However, of course the conventional lever type connector does not have a function of preventing the false fitting that is caused when the electric wire cover is fitted in the wrong direction. Therefore, the electric wire cover can be fitted in the unintended reverse direction. Also, in case the product that is finished after the electric wire cover is fitted to the connector housing to which the lever is fitted is dropped, the damage may be caused in the connector housing at the moment when a great impact is applied to the connector housing. In that case, it takes a lot of time and labor to execute the restoring operation such as the exchange of the connector housing, the reassembling of terminals, or the like. When it is tried to solve respective problems altogether, either a structure of the connector becomes complicated or a size of the connector is increased.

The present invention has been made in view of the above circumstances, and it is an object of the present invention to provide a lever type connector capable of preventing both a false fitting of an electric wire cover and a breakage of a connector housing caused at a time of the drop, with a simple structure.

Solution to Problem

The above object according to the present invention is attained by following configurations.

(1) A lever type connector in which an electric wire cover is attached to a connector housing to which a lever is already fitted, wherein a false fitting preventing projection that protrudes from the electric wire cover and prevents a false fitting of the electric wire cover when the false fitting preventing projection comes into contact with the lever, is provided, and the false fitting preventing projection protrudes outward beyond the connector housing and an outer surface of the lever, and absorbs an impact applied from an outside and serves as a cushioning member against at least the connector housing.

According to this lever type connector, the false fitting preventing projection is provided to the electric wire cover. The false fitting preventing protection interferes with the lever when it is tried to fit the electric wire over reversely, and thus the false fitting of the electric wire cover is blocked. Also, the false fitting preventing projection provided to the electric wire cover is set to protrude outward beyond the connector housing and the outer surface of the lever when the electric wire cover is attached to the connector housing. Hence, the false fitting preventing protection formed on the flexible electric wire cover comes into contact with the ground at first at the moment when the product is dropped. Therefore, the false fitting preventing projection acts as a cushioning member, so that an impact caused at a time of the drop can be absorbed by the cushioning member and thus the impact applied to the connector housing can be softened much more. Also, even when the false fitting preventing projection is broken down due to the drop, an influence on a function of the product as the connector is hardly caused, and thus only the restoring operation for the electric wire cover is required. As a result, the restoring operation can be facilitated in contrast to the breakage of the connector housing that needs the reassembling of the terminals, and also a required time for the restoring operation that is needed due to the breakage can be shortened drastically.

Advantageous Effects of Invention

According to the lever type connector of the present invention, the false fitting preventing projection interferes with the lever when the electric wire cover is attached reversely by mistake, and thus the fitting of the electric wire cover is blocked. Also, the false fitting preventing projection comes into contact with the ground at first when the product is dropped by mistake, and thus the influence upon the connector housing can be reduced. As a result, both the false fitting of the electric wire cover and the breakage of the connector housing caused at a time of the drop can be prevented with the simple structure.

DESCRIPTION OF EMBODIMENTS

An embodiment of the present invention will be explained with reference to the drawings hereinafter.

Figure 1:
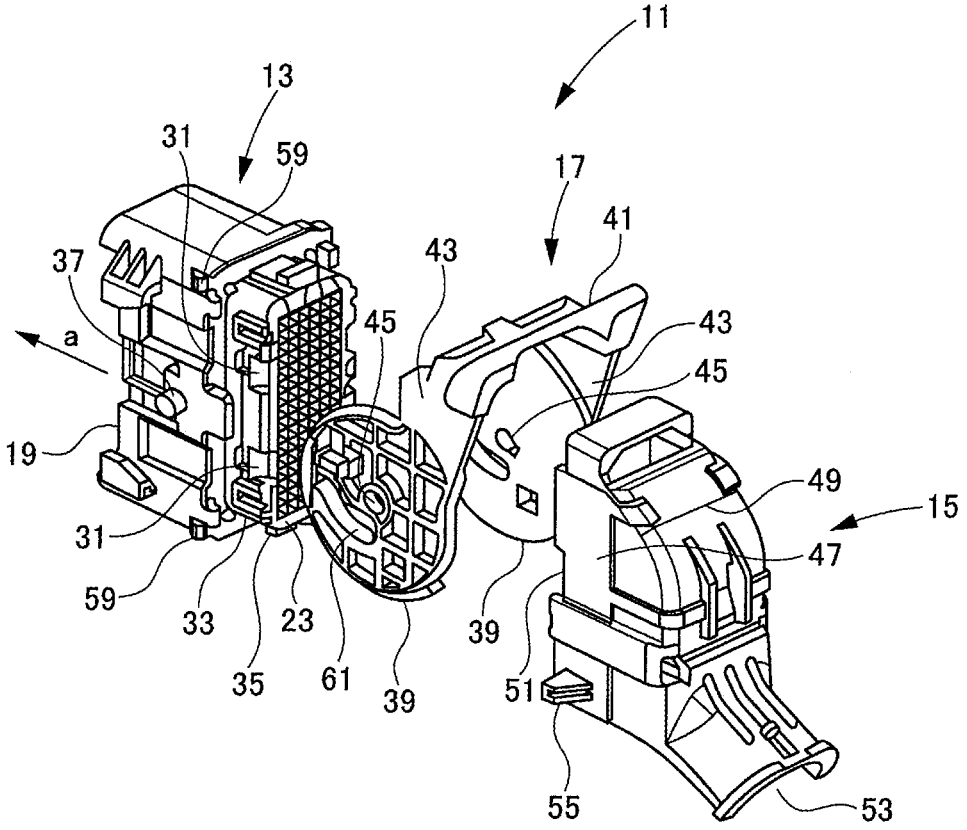
FIG. 1 is an exploded perspective view of a lever type connector according to the present invention.

FIG. 1 is an exploded perspective view of a lever type connector according to the present invention.

A lever type connector 11 is equipped with a connector housing 13, an electric wire cover 15, and a lever 17. The connector housing 13, the electric wire cover 15, and the lever 17 are formed as an integral molding product made of a resin (for example, PBT (polybutylene terephthalate), or the like) respectively. The connector housing 13 is formed like an almost rectangular parallelepiped shape, and a fitting opening portion 19 is formed on a front surface of this connector housing in the fitting direction indicated with an arrow (a) direction. Here, in this specification, the connector housing 13 will be explained under the assumption that the fitting side is set as a front side and the opposite side is set as a rear side. In the lever type connector 11, according to the turning operation of the lever 17 provided to reduce a fitting force, an opposite connector (not shown) is pulled up to the fitting opening portion 19 and is fitted therein. Therefore, the fitting direction (a) denotes the relative fitting direction of the connector housing 13 to the opposite connector.

Figure 2:
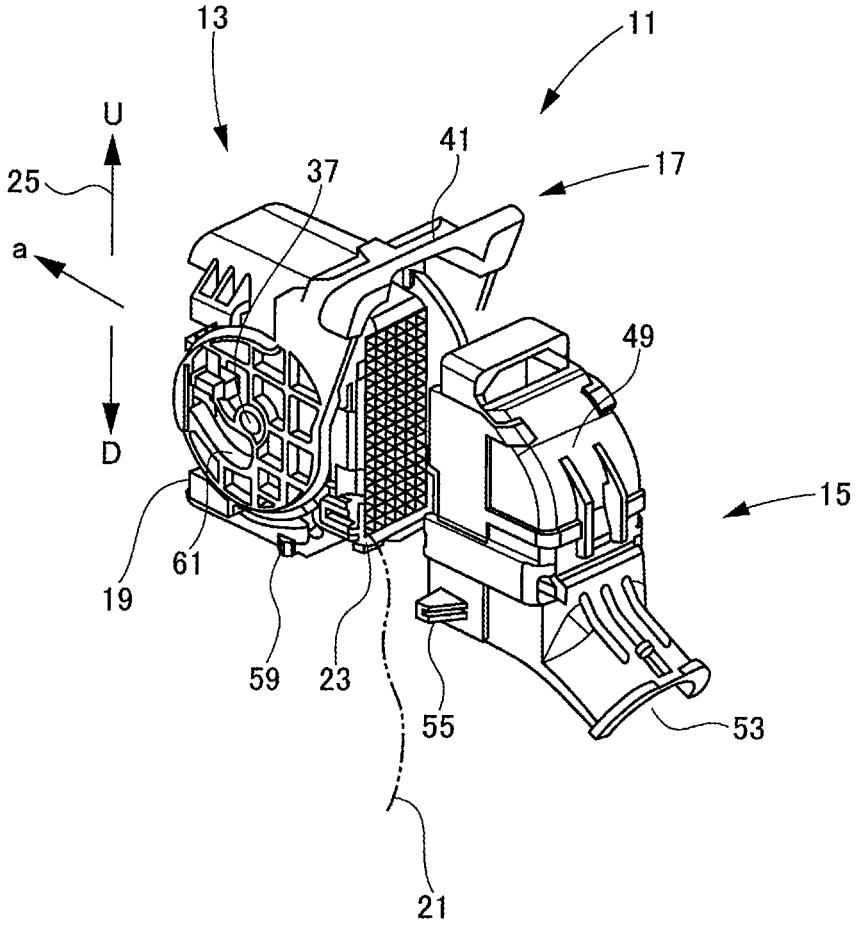
FIG. 2 is an exploded perspective view showing a fitting situation of an electric wire cover of the lever type connector in FIG. 1.
Figure 3:
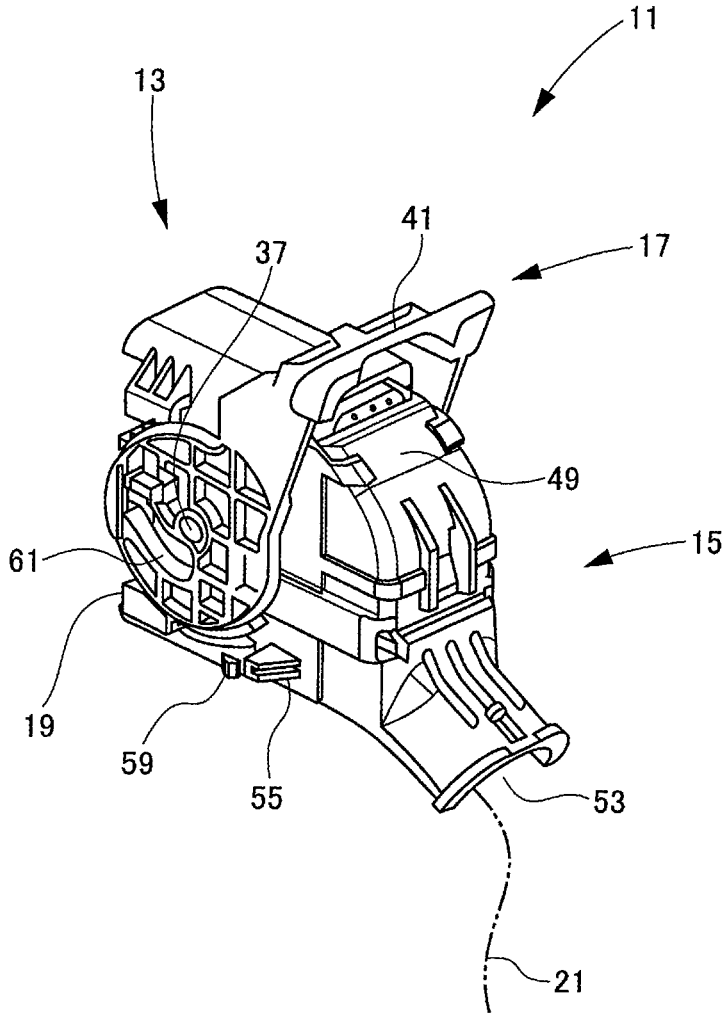
FIG. 3 is a perspective view of the lever type connector that is completely assembled.

FIG. 2 is an exploded perspective view showing a fitting situation of the electric wire cover, and FIG. 3 is a perspective view of the lever type connector that is completely assembled.

Entering openings (not shown) for terminals of the opposite connector are provided in a matrix fashion in the fitting opening portion 19. The entering openings are communicated correspondingly with terminal containing cells (not shown), and a terminal metal fixture (not shown) is contained in the terminal containing cells respectively. An electric wire 21 is connected to the rear end of the terminal metal fixture, and the electric wire 21 is led from a rear surface 23 of the connector housing 13. The electric wire 21 led from the rear surface 23 is pulled out to curve in one direction U or the other direction. D taken along straight line 25 in FIG. 2, which intersects orthogonally with the fitting direction (a), according to the specifications of the connector-equipped vehicle.

A pair of cover latching projections 31 for latching the electric wire cover 15, as shown in FIG. 1, are provided on both side portions of the connector housing 13 respectively. The cover latching projections 31 are latched by cover latching portions (not shown) formed on the inner side of the electric wire cover 15. The electric wire cover 15 is fitted to cover the rear surface 23 of the connector housing 13 when the cover latching projections 31 are latched by the cover latching portions respectively. The cover latching projections 31 are provided to the connector housing 13 bilaterally symmetrically. In the lever type connector 11, the electric wire cover 15 is attached to the connector housing 13 after the lever 17 is attached to the connector housing 13.

Latching pawls 35 are provided to a side surface 33 of the connector housing 13 shown in FIG. 1 to protrude from there. These latching pawls 35 are latched in latching portions (not shown) of the electric wire cover 15 when the electric wire cover 15 is to be fitted. A pivot 37 is provided to both side portions of the connector housing 13 to protrude from there respectively. This pivot 37 is provided to intersect orthogonally with the fitting direction (a) and intersect orthogonally with the above direction of the straight line 25. A temporarily latching projection (not shown) is formed at left and right ends of both side portions of the connector housing 13 respectively. The temporarily latching projections are latched in lever temporary latch holding portions (not shown) of the lever 17. The lever 17 is held in a temporarily latching position when the lever temporary latch holding portions are latched by the temporarily latching projections.

The lever 17 consists of a pair of substantially circular parallel plates 39, and a grasping portion 41 for coupling outer peripheral portions of the parallel plates 39 together. Portions formed between the parallel plates 39 and the grasping portion 41 constitute an arm portion 43 respectively. The above lever temporary latch holding portion (not shown) is formed on one side portions of the arm portions 43 respectively. A socket hole 45 into which the pivot 37 of the connector housing 13 is inserted is provided in the parallel plates 39 respectively. The lever 17 can be fitted selectively to the connector housing 13 in two-way directions in which the direction of the turning operation of the lever 17 on the pivot 37 is set clockwise or anticlockwise.

The electric wire cover 15 is formed like a box shape that is opened in two directions. This box shape is formed by coupling one end portions of a pair of parallel side plates 47 with an oblique wall plate 49 together. One opening of the electric wire cover 15 constitutes an electric wire picking opening 51 that covers the rear surface 23 of the connector housing 13, while the other opening of the electric wire cover 15 constitutes leading opening 53 of the electric wire 21. The cover latching portion, which is latched by the cover latching projection 31 of the connector housing 13, is formed on the inner sides of the side plates 47 respectively.

The cover latching projections 31 provided to the connector housing 13 are arranged bilaterally symmetrically, as described above. Therefore, the electric wire cover 15 can be fitted selectively to the connector housing 13 in two-way directions such that the leading opening 53 of the electric wire 21 is set in one direction U or the other direction D taken along the straight line 25. That is, the electric wire cover 15 can be fitted selectively onto the connector housing 13 in both the non-reverse direction and the reverse direction as the opposite direction to the non-reverse direction.

Figure 4:
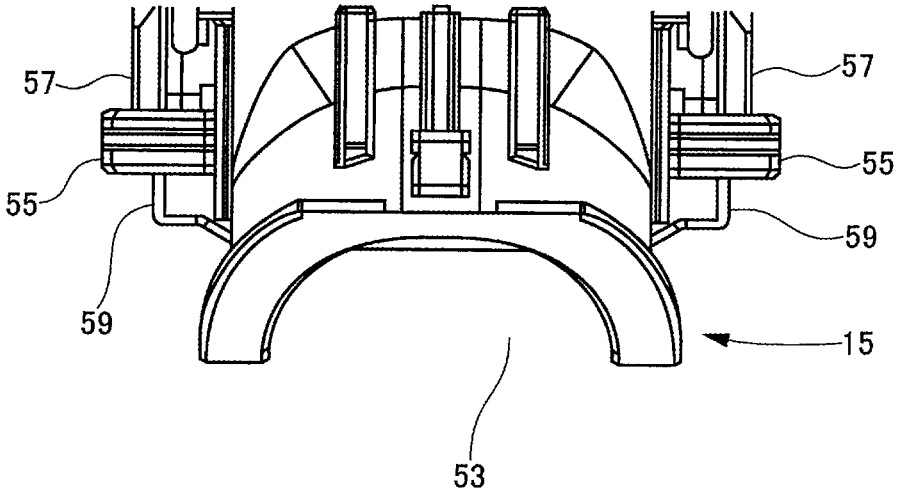
FIG. 4 is a front view of the lever type connector in FIG. 3 when viewed from the leading opening side of the electric wire.
Figure 5:
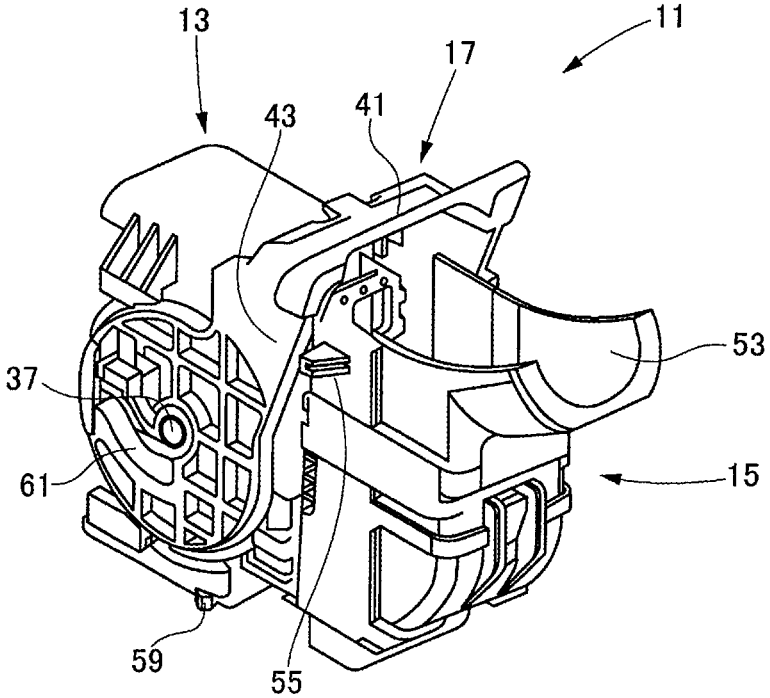
FIG. 5 is a perspective view of the lever type connector to which a lever is reversely fitted.

FIG. 4 is a front view of the lever type connector in FIG. 3 when viewed from the leading opening side of the electric wire, and FIG. 5 is a perspective view of the lever type connector to which the lever is reversely fitted.

In the lever type connector 11, the electric wire cover 15 is attached to the connector housing 13 to which the lever 17 is already fitted. As described above, the electric wire cover 15 can be fitted selectively in two-way directions such that the leading opening 53 of the electric wire 21 is directed in one direction U or the other direction D. Also, the lever 17 can be fitted selectively in two-way directions such that the grasping portion 41 is directed in one direction U or the other direction D. The electric wire cover 15 and the lever 17 are fitted mutually in such a relative positional relationship that the grasping portion 41 of the lever 17 is not fitted on the leading opening 53 side of the electric wire cover 15. When the grasping portion 41 is fitted on the leading opening 53 side, the false fitting of either the electric wire cover 15 or the lever 17 occurs.

A false fitting preventing projection 55 is provided to both side surfaces of the electric wire cover 15 to protrude from there respectively. This false fitting preventing projection 55 prevents the false fitting of the electric wire cover 15 when this projection 55 is caused to contact the lever 17. As shown in FIG. 4, the false fitting preventing projection 55 protrudes outward beyond the connector housing 13 and an outer surface 57 of the lever 17. As shown in FIG. 5, when the electric wire cover 15 is fitted by mistake in the opposite direction to the fitting direction of the lever 17, the false fitting preventing projection 55 is caused to contact the arm portion 43 of the lever 17. As a result, the false fitting of the electric wire cover 15 is detected.

Also, the false fitting preventing projection 55 is constructed to absorb an impact applied from the outside and serve at least as a cushioning member against the connector housing 13. A beak 59 for preventing a reverse turning of the lever 17 is provided to top and bottom ends of on both side surfaces of the connector housing 13 respectively. As shown in FIG.4, the false fitting preventing projection 55 is provided to protrude outward beyond the beak 59.

In the lever type connector 11, the opposite connector (not shown) is fitted into the fitting opening portion 19. At this time, guide pins (not shown) provided to the opposite connector are pushed into guide holes 61 in the lever 17 respectively. According to the turning operation of the lever, the guide pins are pulled up to the connector housing 13, and then the opposite connector is fitted into the fitting opening portion 19 of the connector housing 13.

Next, an action of the lever type connector 11 having the above configuration will be explained hereunder.

Figure 6:
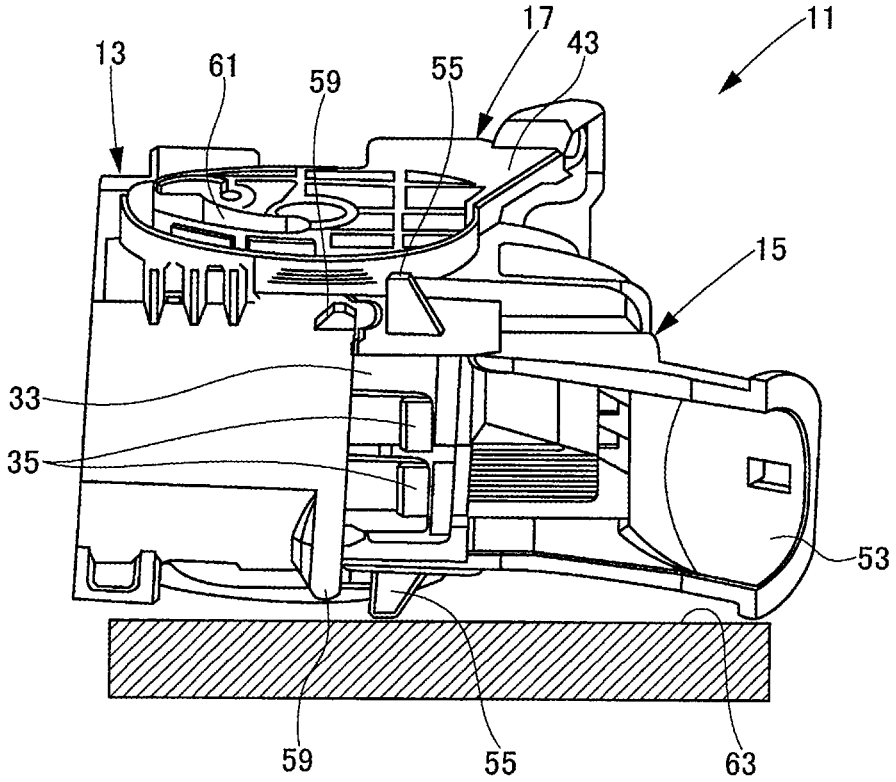
FIG. 6 is a side view of the lever type connector according to the present invention at the moment when a false fitting preventing projection comes in contact with a ground.

FIG. 6 is a side view of the lever type connector according to the present invention at the moment when the false fitting preventing projection comes into contact with the ground.

In assembling the lever type connector 11, first the lever 17 is fitted to the connector housing 13 in a predetermined direction. Then, the electric wire cover 15 is fitted to the connector housing 13 to which the lever 17 is already fitted. The electric wire cover 15 is put on the rear surface 23 of the connector housing 13, and then is attached to the connector housing 13 by latching the cover latching portion (not shown) by the cover latching projections 31.

As shown in FIG. 3, when the electric wire cover 15 is attached in the regular direction, the leading opening 53 is positioned on the opposite side to the grasping portion 41. In contrast, as shown in FIG. 5 in the false fitting in which the leading opening 53 is positioned on the same side as the grasping portion 41, the false fitting preventing projection 55 interferes with the arm. portion 43 of the lever 17. As a result, the false fitting of the electric wire cover 15 is blocked.

Also, the false fitting preventing projection 55 provided to the electric wire cover 15 is set to protrude outward beyond the connector housing 13 and the outer surface 57 of the lever 17, as shown in FIG.4, after the electric wire cover 15 is attached to the connector housing 13. Accordingly, as shown in FIG.6, the false fitting preventing projection 55 comes into contact with a ground 63 at first at the moment when the product is dropped. Hence, the false fitting preventing projection 55 that comes into contact with the ground 63 at first acts as a cushioning member at the moment when the product is dropped. Therefore, an impact caused at a time of the drop can be absorbed by the cushioning member, and thus the impact applied to the connector housing 13 can be softened much more. Also, even when the false fitting preventing projection 55 is broken down due to the drop, an influence on a function of the product as the connector is hardly caused, and thus only the restoring operation for the electric wire cover 15 is required. As a result, the restoring operation can be facilitated in contrast to the breakage of the connector housing 13 that needs the reassembling of the terminals, and also a required time for the restoring operation that is needed due to the breakage can be shortened drastically.

The present application is based on Japanese Patent Application No. 2010-163083 filed on Jul. 20, 2010, the entire contents of which are incorporated herein by reference.

Industrial Applicability

Therefore, according to the lever type connector 11 of the present embodiment, when the electric wire cover 15 is fitted reversely by mistake, the false fitting preventing projection 55 interferes with the lever 17, and thus the fitting of the electric wire cover 15 is blocked. Also, the false fitting preventing projection 55 comes into contact with the ground 63 at first at the moment when the product is dropped by mistake, and thus the influence upon the connector housing 13 can be reduced. As a result, both the false fitting of the electric wire cover 15 and the breakage of the connector housing caused at a time of the drop can be prevented with a simple structure.

Reference Signs List

11 lever type connector
13 connector housing
15 electric wire cover
17 lever
55 false fitting preventing projection
57 outer surface

The invention claimed is:

1. A lever type connector in which an electric wire cover is attached to a connector housing to which a lever is already fitted, wherein a lever includes a pair of parallel plates and a grasping portion coupling the parallel plates together, wherein a false fitting preventing projection that protrudes from the electric wire cover and prevents a false fitting of the electric wire cover when the false fitting preventing projection comes into contact with the pair of parallel plates of the lever, is provided, and the false fitting preventing projection protrudes outward beyond the connector housing and an outer surface of the lever in a direction perpendicular to plate surface of the pair of parallel plates, and absorbs an impact applied from an outside and serves as a cushioning member against at least the connector housing.

* * * * *